United States Patent [19]

Vosbikian

[11] 4,333,198

[45] Jun. 8, 1982

[54] SPONGE MOP

[76] Inventor: Joseph Vosbikian, 617 Ashmead St., Cheltenham, Pa. 19012

[21] Appl. No.: 216,156

[22] Filed: Dec. 15, 1980

[51] Int. Cl.[3] ..... A47L 13/144

[52] U.S. Cl. ..... 15/119 A

[58] Field of Search ..... 15/119 R, 119 A

[56] References Cited

U.S. PATENT DOCUMENTS

| | | | |
|---|---|---|---|
| 2,127,055 | 8/1938 | Christopher | 15/119 R |
| 2,235,264 | 3/1941 | Rogers | 15/119 A |
| 2,926,373 | 3/1960 | Knapp | 15/119 A |
| 3,727,259 | 4/1973 | Wilson . | |
| 4,196,488 | 4/1980 | Barry | 15/119 A |

FOREIGN PATENT DOCUMENTS

| | | | |
|---|---|---|---|
| 587229 | 1/1959 | Italy | 15/119 A |
| 775135 | 5/1957 | United Kingdom | 15/119 A |
| 985124 | 3/1965 | United Kingdom | 15/119 A |
| 1128520 | 9/1968 | United Kingdom | 15/119 A |
| 1277599 | 6/1972 | United Kingdom | 15/119 A |

OTHER PUBLICATIONS

"Selectmop Instructions".

"Automatic Roller Mop" cover sheet and instructions issued by Quickie Manufacturing Corporation.

*Primary Examiner*—Robert L. Bleutge

*Attorney, Agent, or Firm*—Weiser, Stapler & Spivak

[57] ABSTRACT

The sponge mop includes a hollow cylindrical body which terminates at its lower end in a bridge which supports rollers in spaced alignment a predetermined distance on each side of the axis of the body for sponge squeezing purposes. An operating handle is axially movable through the body and is engaged at one end with a sponge carrier to pull the sponge through the rollers for water wringing purposes and to push the sponge below the rollers for work purposes.

6 Claims, 4 Drawing Figures

SPONGE MOP

BACKGROUND OF THE INVENTION

The present invention relates generally to the field of cleaning devices, and more particularly, is directed to a novel, easily usable and improved sponge mop.

The design of sponge mop of the type wherein a sponge is attached to a handle in combination with a sponge wringing mechanism is well known and many prior workers in the art have developed various designs and configurations with more or less commercial success. In one type of prior art sponge mop, as exemplified by U.S. Pat. Nos. 2,643,407 and 2,834,035 the sponge, with its carrier, is positioned at the lower end of a handle and a lever type operator is employed exteriorly of the handle to fold the sponge double for water wringing purposes. Other workers in the field have developed sponge mop handles having rollers positioned at the bottom thereof to wring water from a sponge as the sponge is pulled through a constricted area defined between the rollers by use of an external lever or operating mechanism.

While the prior art sponge mops have generally proved satisfactory for the service, construction and operating difficulties have developed because of the external, lever or other type operators. Accordingly, there remains a need for a simply designed, sturdy, reliable and inexpensive sponge mop.

SUMMARY OF THE INVENTION

The present invention relates generally to the field of sponge mops, and more particularly, is directed to a sponge mop of the roller wringing type which functions in an improved manner without the need for external levers or any off center wringing mechanism.

The sponge mop of the present invention comprises generally a hollow, cylindrical body which terminates downwardly in a bridge of a design suitable to retain a plurality of spaced rollers in a workable, sponge constricting arrangement. The bridge bifurcates downwardly to stationarily position a pair of roller shafts at right angles to the axis of the body in parallel alignment and spaced equally respectively outwardly from the periphery of the handle. A plurality of rollers are carried by the roller shafts to facilitate wringing the sponge by defining a constricted area therebetween. By pulling the sponge upward through the constricted area, the sponge will be squeezed between the spaced rollers to thereby wring or shed water retained by the sponge. An operating handle is reciprocal within the hollow body and includes an upper gripping portion for actuating the wringing action and a lower, threaded stud for engaging the sponge carrier in a releasable manner to permit replacement of the sponge assembly upon evidence of wear.

In accordance with the teachings of the present invention, all necessary upwardly directed forces required to wring water from the sponge or downwardly directed forces to expose the sponge below the rollers for cleaning action are axially applied by reciprocating the handle within the hollow body. All forces necessary for sponge wringing purposes are applied directly in axial alignment whereby the reciprocation of the sponge above and below the rollers can be accomplished with minimum forces in a fully balanced manner, thereby to assure most efficient application of force. The simplified wring means design requires the utilization of only a minimum number of operating parts.

It is therefore an object of the present invention to provide an improved sponge mop of the type set forth.

It is another object of the present invention to provide a novel sponge mop including axially aligned reciprocating means releasably connected to a sponge assembly to facilitate wringing water from the sponge upon application of minimum axially directed forces.

It is another object of the present invention to provide a novel sponge mop including a hollow body which terminates downwardly in a bridge suitable to maintain a pair of rollers in spaced, parallel relationship below the body and at right angles thereto, an operating handle connected to a sponge assembly and being axially reciprocal through the hollow body whereby the sponge may be squeezed between the rollers upon the application only of axially aligned forces.

It is another object of the present invention to provide a novel sponge mop including an integral, hollow body and roller bridge to retain a pair of rollers in spaced, parallel relationship below the bottom of the body, an operating handle positioned within the hollow body and being axially reciprocal therewithin to wring a sponge between the rollers, a sponge assembly and easily engageable means between the operating handle and the sponge assembly to facilitate ready replacement of the sponge assembly upon exhibition of signs of wear.

It is another object of the present invention to provide a novel sponge mop that is simple in design, inexpensive in manufacture and trouble free when in use.

Other objects and a fuller understanding of the invention will be had by referring to the following description and claims of a preferred embodiment thereof, taken in conjunction with the accompanying drawings, wherein like reference characters refer to similar parts throughout the several views and in which:

BRIEF DESCRIPTION OF THE DRAWINGS

FIG. 2 is an exploded, perspective view of the sponge mop of FIG. 1.

DESCRIPTION OF THE PREFERRED EMBODIMENT OF THE INVENTION

Figure 1:
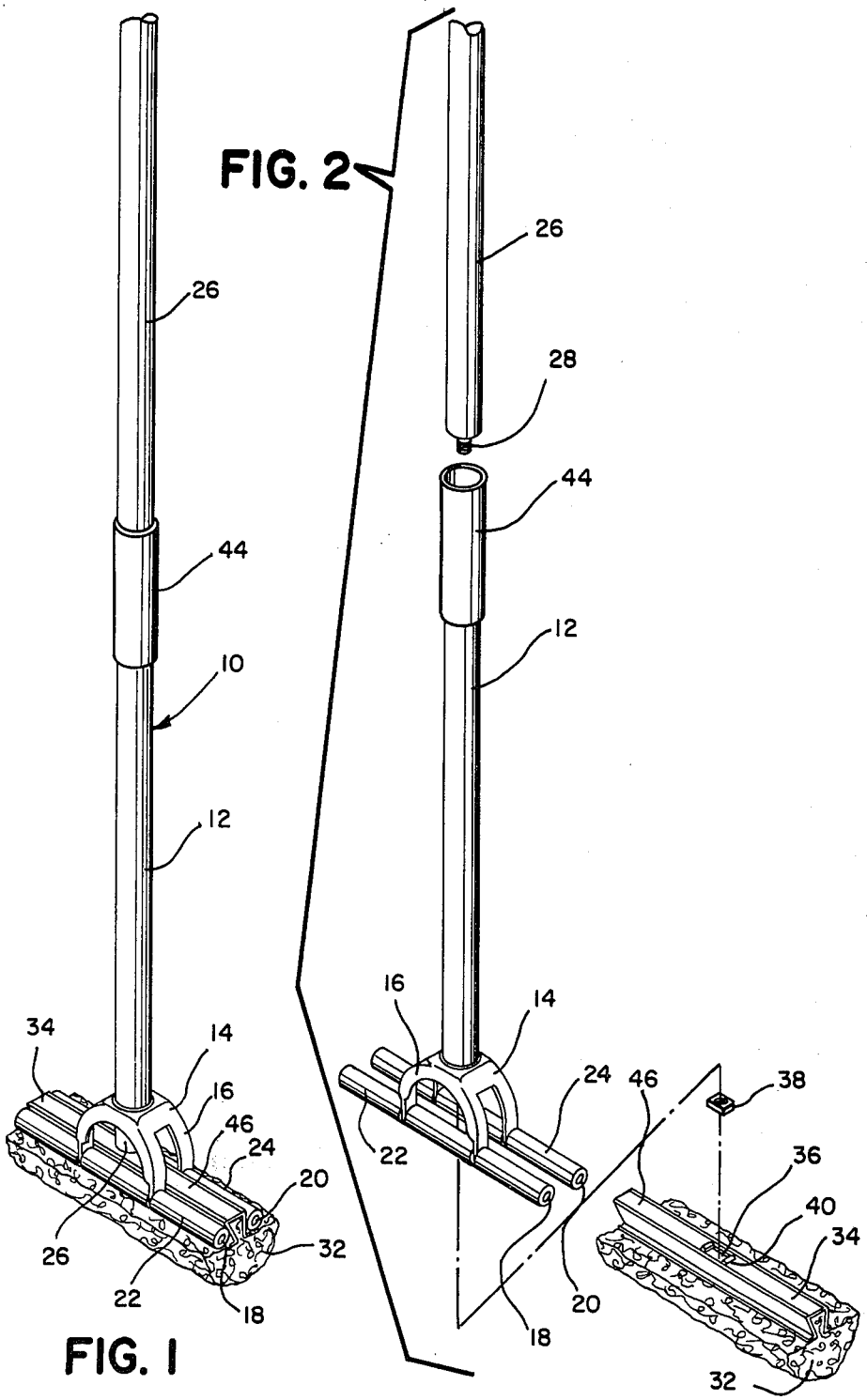
FIG. 1 is a perspective view of the sponge mop constructed in accordance with the present invention.

Although specific terms are used in the following description for the sake of clarity, these terms are intended to refer only to the particular structure of the invention selected for illustration in the drawings, and are not intended to define or limit the scope of the invention.

Referring now to the drawings, there is illustrated in FIGS. 1 and 2 a sponge mop generally designated 10 which comprises a hollow, cylindrical, elongate body 12 to which is bottomly connected a sponge squeezing assembly comprising an arched bridge 14, means for holding rollers in parallel, spaced relationship at right angles to the axis of the body and a plurality of rollers. The body 12 terminates upwardly in a grip portion 44 to facilitate axial operation of the device in the manner hereinafter more fully set forth.

The bridge 14 includes a plurality of depending legs 16, which legs are arranged in left and right pairs to secure the roller shafts 18, 20 below the body equidistantly from the axis of the body 12. The shafts 18, 20 are outwardly equally spaced from the axis of the body 12 to secure rollers in spaced relationship from the body axis below the bottom terminus of the body. A plurality of rollers 22 are rotatively retained on the shaft 18 and a similar plurality of rollers 24 are rotatively retained on the shaft 20. The rollers function to squeeze or wring water from the sponge 32 as the sponge mop is operated in the manner hereinafter more fully set forth. Preferably, both the body 12 and the bridge 14 are fabricated of metal which can be treated in known manner to resist rust and other deterioration. The interconnection between the body 12 and bridge 14 may be made in any known, sturdy manner, for example by crimping, spot welding, swaging, etc.

Figure 3:
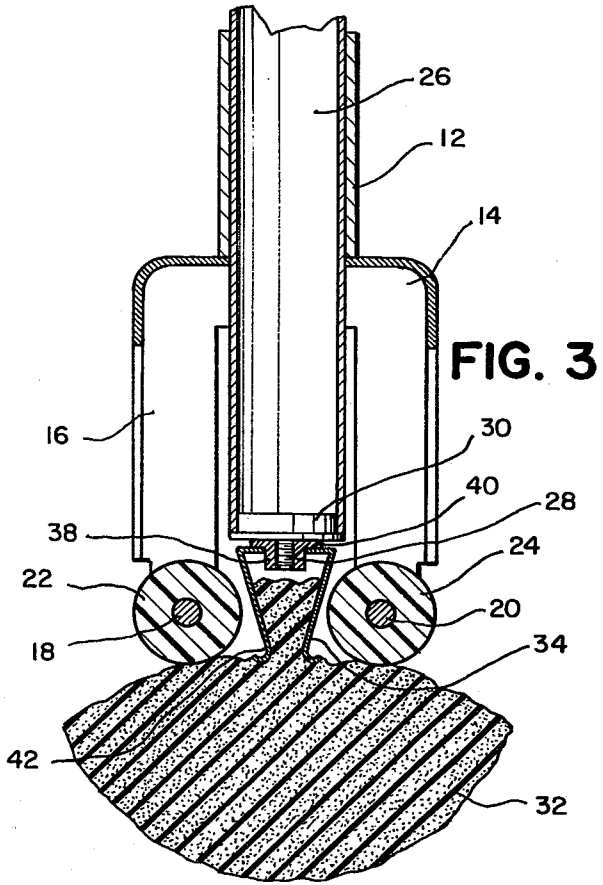
FIG. 3 is an enlarged, cross sectional view taken along line 3—3 of the FIG. 1, looking in the direction of the arrows.
Figure 4:
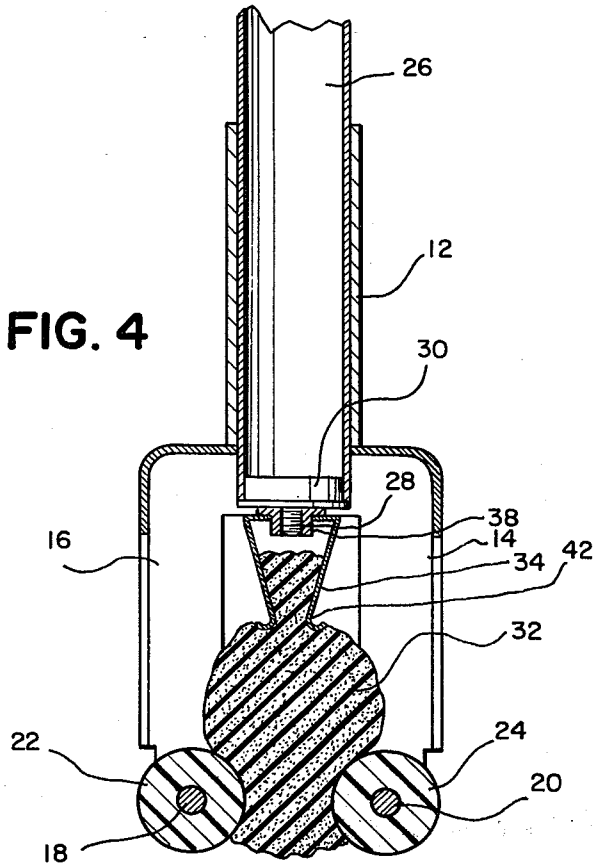
FIG. 4 is an enlarged, cross sectional view similar to FIG. 3, showing the sponge in squeezed position to wring out water therefrom.

A handle 26 is reciprocal within the interior of the body 12 and extends upwardly therefrom as best seen in FIG. 1 for grasping purposes to facilitate both using the mop in the usual manner and for wringing water from the sponge in the manner more fully hereinafter fully discussed. A sponge assembly connector means, which may be a threaded stud 28, bottomly projects from the operating handle 26 and may be secured therein in any suitable, known manner. For example, if the handle 26 is fabricated of wood, then the stud 28 could be threadedly engaged therein or perhaps could be adhesively secured within a suitable, predrilled bore (not shown). In the embodiment illustrated, as best seen in FIGS. 3 and 4, the operating handle 26 is fabricated of hollow, metallic or plastic tubing of suitable strength. In this embodiment, a bottom, plastic filler plug 30 is secured at the bottom of the operating handle 26. The filler plug 30 may be a press fit or optionally may be cemented or otherwise secured in place in known manner. The threaded stud 28 is secured axially within the filler plug 30 to project downwardly from the bottom of the operating handle 26.

A replaceable sponge assembly which includes a sponge 32, which may be of known, suitable sponge plastic or natural sponge material is fabricated of length equal to the length of the left and right rollers 22, 24 and is upwardly secured within a metallic sponge carrier 34. As best seen in FIGS. 3 and 4, the carrier 34 is generally trapezoidal in cross sectional configuration and includes a planar top and legs depending therefrom, the legs being downwardly constricted to form a restricted neck 42 to thereby squeeze and retain within the carrier 34 the top, longitudinal portion of the sponge 32. The planar top of the carrier 34 is provided with a central opening 36 which is positioned in axial alignment with the body 12 when the sponge 32 is longitudinally aligned with respect to the left and right rollers 22, 24. See FIG. 1.

The sponge carrier opening 36 is preferably equipped with a retainer 40 of known construction to hold therein an engagement means such as a conventional nut 38 in a generally, loose, floating arrangement immediately below the top of the carrier. The retainer 40 functions to always maintain the nut 38 in loose engagement and the nut 38 is always generally axially positioned to receive therein the threaded stud 28 of the operating handle 26. By providing the floating nut arrangement, engagement of the nut with the stud is simiplified inasmuch as the parts need not be precisely aligned in order to threadedly engage the nut 38 by rotating the operating handle 26 (and the affixed stud 28).

As best seen in FIGS. 3 and 4, when the floating nut 38 is engaged by the threads of the stud 28, the sponge carrier 34 will be pulled tightly against the bottom of the operating handle 26 to secure the sponge 32 to the handle. When the sponge 32 has worn and it is desired to replace the sponge assembly, this can simply be accomplished by moving the sponge assembly to the position illustrated in FIG. 3 and then threadedly disengaging the stud 28 from the threaded, floating nut 38 by rotating the handle 26 to thereby allow the sponge 32 and its carrier 34 to be disposed and replaced by another similar, new sponge and carrier combination assembly.

In order to operate the sponge mop 10 of the present invention, the loose parts are assembled and positioned as illustrated in FIG. 3 by engaging the floating nut with the stud 28. The hand grip 44 of the body 12 can be grasped in one hand and the portion of the operating handle 26 exposed above the body 12 can be grasped by the other hand of the operator (not shown). Then by pulling upwardly on the operating handle 26 relative to the body 12, the handle 26 can be urged axially upwardly within the hollow interior of the body 12. Upward, axial movement of the handle 26 within the body 12 causes the attached sponge and carrier assembly 34 to ride upwardly within the space defined between the plurality of depending legs 16 of the bridge 14 from the position illustrated in FIG. 3 to the position illustrated in FIG. 4. Upward movement of the handle 26 relative to the body 12 will be limited by the engagement of the planar top of the carrier 34 against the underside of the web of the bridge 14. See FIG. 4.

As the carrier 34 is upwardly urged within the space defined between the legs 16 of the bridge 14, the interconnection between the carrier 34 and the sponge 32 at the restricted neck 42 will cause the sponge 32 also to be upwardly urged with the carrier as a unitary assembly. It will be noted that the space defined between the left and right rollers 22, 24 is considerably less than the width of the sponge 32 in its unstressed condition. See FIG. 3. Accordingly, as the sponge 32 rides upwardly within the space defined between the left and right rollers 22, 24 water will be squeezed from the sponge 32 in a highly efficient manner upward upon the application of minimum, upward axially directed forces. The axial alignment of the operating handle 26 within the hollow interior of the body 12 assures that only axially directed forces will be applied to the sponge 32 through the connected carrier 34. Following wringing of the water from the sponge 32, a reversal of the axial forces by pushing downwardly on the handle 26 relative to the body 12 will cause the sponge 32 to ride downwardly between the rollers 22, 24 until the carrier 34 is positioned between the rollers 22, 24 as indicated in FIG. 3 and the sponge 32 itself is positioned below the bottom of the rollers 22, 24. In this position, the sponge is fully expanded for cleaning purposes. When the sponge 32 becomes dirty, or when it is desired to apply a fresh solution, the sponge 32 can be dipped into the solution (not shown) and excess solution can then be wrung from the sponge by reciprocation of the parts from the position illustrated in FIG. 3 to the position shown in FIG. 4.

Thus it is seen that only axially directed forces can be applied between the body 12 and the handle 26 and accordingly, only axially aligned forces can act upon the sponge carrier 34 to pull the sponge 32 to the wringing position as illustrated in FIG. 4 and then to push the carrier downwardly until the sponge 32 assumes the cleaning position as illustrated in FIG. 3. It will be observed that a minimum number of working parts will be required and that the axial arrangement of all working parts functions to avoid wear, unbalance and any need to apply excess forces having force vectors that are not axially aligned and that cannot be directly applied in the sponge wringing process.

Although the invention has been described with a certain degree of particularity, it is understood that the present disclosure has been made only by way of example and that numerous changes in the details of construction and the combination and arrangement of parts may be resorted to without departing from the spirit and scope of the invention.

What is claimed is:

1. In a sponge mop, the combination of a hollow body of elongate tubular configuration;

an operating handle adapted for axial reciprocation within the body between a working position and a water wringing position, the handle endwardly carrying a sponge assembly connector means, the sponge assembly connector means comprising a cylindrical, axially aligned fastener means downwardly projecting from the handle;

a sponge squeezing assembly affixed at one end of the hollow body, the sponge squeezing assembly comprising at least a pair of spaced rollers to wring water from the sponge; and a sponge assembly releasably connected to the sponge assembly connector means and comprising a sponge, a sponge carrier and engagement means to engage the sponge assembly fastener means, the engagement means comprising a threaded nut secured to the sponge carrier, the nut releasably engaging the fastener means, at least a major portion of the sponge being pulled between the rollers to drive water from the sponge when the operating handle is reciprocated to its said water wringing position.

2. The sponge mop of claim 1 wherein all functioning portions of the body and all portions of the handle are positioned in axial alignment.

3. The sponge mop of claim 1 wherein the fastener means comprises a threaded stud.

4. The sponge mop of claim 3 and means to hold the nut to permit limited movement between the nut and the sponge carrier to facilitate alignment and engagement of the nut with the stud.

5. The sponge mop of claim 4 and an opening provided in the sponge carrier, the means to hold the nut being secured in the opening whereby the nut may move within the opening in a direction perpendicular to the axis of the handle as necessary to easily be engaged by the threaded stud, even when the parts are not precisely axially aligned.

6. The sponge mop of claim 5 wherein the means to hold the nut to permit movement of the nut within the sponge carrier opening comprises a retainer, the retainer being secured within the opening whereby the retainer has no movement relative to the sponge carrier.

* * * * *